United States Patent [19]

Morrison

[11] 4,454,878

[45] Jun. 19, 1984

[54] OXYGEN ACCUMULATOR FOR CONSTANT PARTIAL PRESSURE SEMI-CLOSED BREATHING APPARATUS

[75] Inventor: James D. Morrison, North Vancouver, Canada

[73] Assignee: Her Majesty the Queen in right of Canada, as represented by the Minister of National Defence of Her Majesty's Canadian Government, Ottawa, Canada

[21] Appl. No.: 342,884

[22] Filed: Jan. 26, 1982

[51] Int. Cl.[3] ..... A61M 16/00

[52] U.S. Cl. ..... 128/201.27; 128/204.22

[58] Field of Search ..... 128/201.27, 201.28, 128/204.22

[56] References Cited

U.S. PATENT DOCUMENTS

| | | | |
|---|---|---|---|
| 3,820,537 | 6/1974 | Almqvist et al. | 128/201.27 |
| 3,859,994 | 11/1975 | Almqvist et al. | 128/201.27 |
| 3,924,618 | 12/1975 | Banjavich et al. | 128/201.27 |
| 4,037,594 | 7/1977 | Riegel et al. | 128/201.27 |
| 4,362,154 | 12/1982 | Le Masson | 128/204.22 |

FOREIGN PATENT DOCUMENTS 1342155 12/1973 United Kingdom .

*Primary Examiner*—William E. Kamm
*Assistant Examiner*—Mitchell J. Shein
*Attorney, Agent, or Firm*—Roylance, Abrams, Berdo & Goodman

[57] ABSTRACT

The invention relates to improvements in a diver's semi-closed circuit breathing apparatus and is intended to better control the partial pressure of oxygen during descent and ascent. Such apparatus includes a counterlung, sources of oxygen and inert gas, an oxygen regulator, a mass flow jet in the oxygen circuit, a regulator for the inert gas, and a feed-back controlled laminar flow element for feeding a mixture of the oxygen and inert gas to a counterlung of the breathing apparatus. The improvement comprises the provision of an oxygen accumulator in the oxygen circuit following the mass flow jet so that a portion of the delivered oyxgen is diverted thereto during descent to counteract oxygen partial pressure overshoot. At constant depth the apparatus operates normally, maintaining appropriate oxygen partial pressure, and, during ascent, oxygen is returned from the accumulator to the breathing apparatus to counteract any drop in oxygen partial pressure.

4 Claims, 10 Drawing Figures

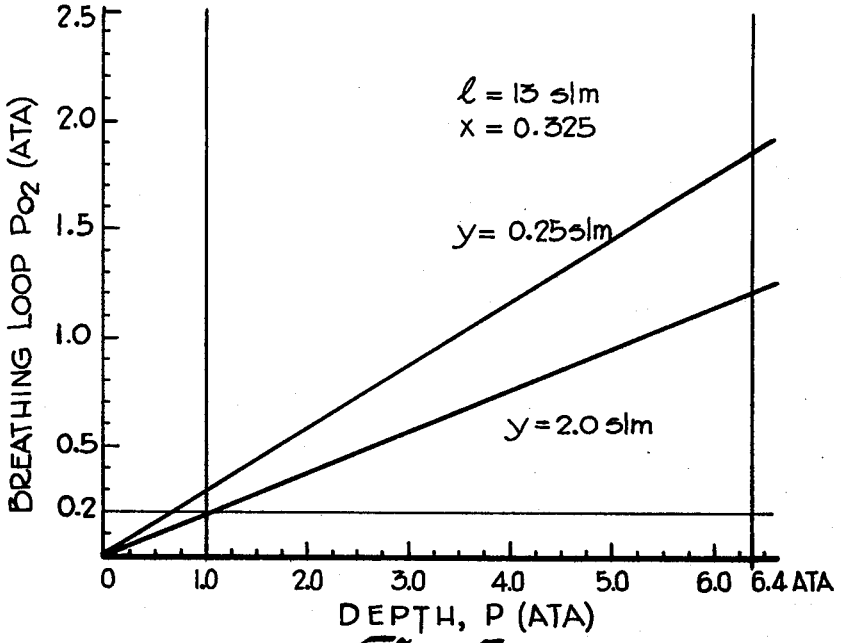
~Fig~3~ (PRIOR ART)
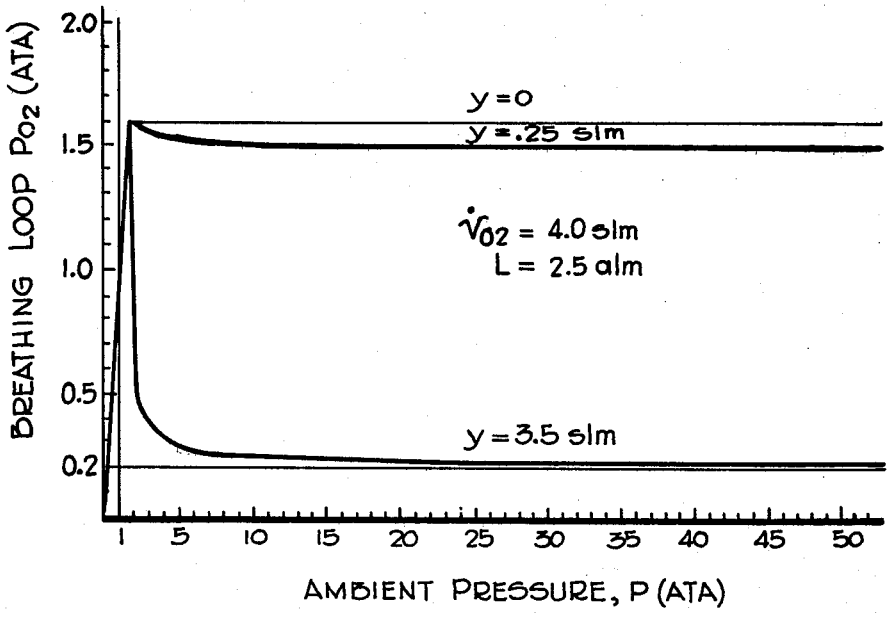
~Fig~5~ (PRIOR ART)

OXYGEN ACCUMULATOR FOR CONSTANT PARTIAL PRESSURE SEMI-CLOSED BREATHING APPARATUS

This invention relates to a device for supplying oxygen to a semi-closed circuit breathing apparatus, especially for sub-surface divers.

BACKGROUND OF THE INVENTION

The present application represents an improvement in the method and apparatus for supplying gas mixtures to a diver's breathing apparatus as taught in British Pat. No. 1,342,155 (National Research Development Corporation) published Dec. 28th, 1973.

Self-contained underwater breathing apparatus can be grouped into three basic categories according to the configuration of the breathing circuit:

(i) open circuit (ii) semi-closed circuit (iii) closed circuit

A parameter of prime concern in the design and operation of such an apparatus is the partial pressure of oxygen delivered to the diver. This must be kept within limits over the depth range of the apparatus for all diver oxygen uptakes.

In open circuit apparatus, the diver breathes the supply gas mixture directly by drawing it through a demand regulator on inhalation and dumping it overboard through an exhaust valve on exhalation. The oxygen partial pressure of the gas being breathed is identical to that of the supplied gas and can be selected by choosing the right mixture.

In semi-closed and closed circuit apparatus, the diver breathes the gas circulating in a breathing loop which consists of a breathing bag or counterlung, a carbon dioxide scrubber and associated plumbing. Various gases are added to and removed from this loop, including the supply gas. Therefore, the diver is breathing a gas with an oxygen partial pressure which is the resultant of the various gas transfers going on and the oxygen partial pressure of this gas is usually not the same as that of the supply gas. In these two categories of apparatus, then, it is the breathing loop oxygen partial pressure which must be controlled; in particular, the oxygen partial pressure in the counterlung.

The most direct way of controlling the counterlung oxygen partial pressure is by closed loop feedback control using an oxygen sensor. This is the method used in closed circuit apparatus and results in the most accurate control and the least gas consumption. It is also the most expensive and complex.

The conventional method of controlling counterlung oxygen partial pressure in existing semi-closed circuit sets is an open-loop control method. It consists of controlling the supply gas mixture and mass flow rate to the breathing loop. The mixture is held constant by selection and the mass flow of mixture is held constant by a choked venturi (mass-flow jet). This gas supply configuration, coupled with the other gas transfers going on in the loop, results in a predictable counterlung oxygen partial pressure range. A disadvantage of this arrangement is that, if it is to do any better than open circuit apparatus as far as gas consumption is concerned, several mixtures and flow rates must be used to cover various depth ranges. This creates gas supply logistics problems and means that such an apparatus cannot be used from the surface down to its maximum depth on a given control setting.

The method of open loop control of counterlung oxygen partial pressure in semi-closed circuit apparatus as taught in the aforementioned British patent overcomes most of the above problems. However, it has been found that the traditional static analysis of counterlung oxygen partial pressure is not sufficient for the design of the gas control system for such apparatus as it is for conventional sets.

SUMMARY OF THE INVENTION

It has now been determined that a dynamic analysis of counterlung oxygen partial pressure is required to predict the transient behavior of counterlung oxygen partial pressure during and after depth changes. Such dynamic analysis will be presented hereinafter with reference to the drawings and in comparison with the static case. It is sufficient to state at this point that the dynamic analysis has led to an improvement in semi-closed circuit breathing apparatus of the type taught in the aforementioned British patent wherein an oxygen accumulator is provided in the oxygen supply line downstream of the regulator and mass flow jet already provided therein. As the diver descends, some of the oxygen delivered by the mass flow jet is diverted to the accumulator thereby reducing the oxygen delivered to the breathing loop and this in turn counteracts any overshoot of oxygen partial pressure on descent. At a constant depth the accumulator retains the collected oxygen and the normal oxygen flow rate to the breathing loop is restored. On ascent, the accumulator discharges its contents and the excess oxygen is delivered to the breathing loop to counteract a dropping oxygen partial pressure which would otherwise occur on ascent.

Broadly speaking, therefore, the present invention may be seen as providing semi-closed circuit breathing apparatus comprising: a counterlung; an oxygen source; means for feeding oxygen from the oxygen source to an oxygen regulator and then to a mass flow jet; an inert gas source; means for feeding inert gas from the inert gas source to an inert gas regulator and then to an inert gas low pressure diluent regulator; a laminar flow element; first conduit means connected between the diluent regulator and the laminar flow element; second conduit means connected between the mass flow jet and the first conduit means; third conduit means connected between the laminar flow element and the counterlung; a pressure feed-back loop from the counter-lung to the diluent regulator; an oxygen accumulator; and means connecting the oxygen accumulator to the second conduit means; whereby during descent a portion of oxygen delivered by the mass flow jet is accumulated in the accumulator to be retained therein at constant depth, and during ascent the retained oxygen is discharged therefrom into the second conduit means, so as to counteract oxygen partial pressure transients during descent and ascent.

Furthermore the present invention provides in the method of supplying a variable gas mixture of constant oxygen partial pressure to a diver's semi-closed breathing apparatus wherein oxygen is supplied via a constant mass flow device, is mixed with an inert gas, and the mixture is supplied via a laminar flow element to a counterlung of the breathing apparatus with the supply thereof being regulated by a feed-back loop to ensure a constant pressure drop across the laminar flow element, the improvement wherein a portion of the supplied oxygen is accumulated in an oxygen accumulator during descent to counteract oxygen partial pressure overshoot, is retained in the accumulator at constant depth, and is returned to the breathing apparatus during ascent to counteract dropping oxygen partial pressure.

BRIEF DESCRIPTION OF THE DRAWINGS

FIG. 3 shows a graph of steady-state oxygen partial pressure for the apparatus of FIG. 1.

FIG. 5, shows a graph of steady state breathing loop oxygen partial pressure versus depth for the apparatus of FIG. 4.

DESCRIPTION OF THE PREFERRED EMBODIMENT

Before discussing the dynamic analysis which led to the present invention it is deemed desirable to present appropriate analyses of the prior art systems to illustrate the weaknesses therein. For the subsequent analyses the following symbols and abbreviations will be used:

ata=Atmospheres Absolute
alm=Actual Liters Per Minute
slm=Standard Liters Per Minute
al=Actual Liters
sl=Standard Liters
l=supply gas flow (slm)
L=supply gas flow (alm)
P=depth or ambient pressure (ata)
$P_{02}$=oxygen partial pressure (ata)
t=time (min)
$\dot{V}_A$=gas flow to breathing loop from auxiliary gas control circuit (slm)
$\dot{V}_A$=gas flow to breathing loop from auxiliary gas control circuit (alm)
$\dot{V}_C$=the compensation requirement, i.e., the gas flow into or out of the breathing loop required to compensate for the effect of ambient pressure change (alm)
$\dot{V}_{CO2}$=carbon dioxide production of diver (slm)
$\dot{V}_E$=flow of gas through exhaust valve (slm)
$\dot{V}_E$=flow of gas through exhaust valve (alm)
$\dot{V}_I$=the inert gas flow from the main gas control circuit to the breathing loop (slm)
$\dot{V}_I$=the inert gas flow from the main gas control circuit to the breathing loop (alm)
$\dot{V}_{PH}$=the net physiological gas flow to the breathing loop which maintains physiologically safe steady state $P_{02}$ levels (alm)
$v_{02}$=volume of oxygen in breathing loop (sl)
$v_{02}$=initial volume of oxygen in breathing loop (sl)
$V_{02}$=initial volume of oxygen in breathing loop (al)
$\dot{v}_{02}$=oxygen flow rate (slm)
$\dot{V}_{02}$=oxygen flow rate (alm)
$v_s$=breathing loop volume (sl)
$V_s$=breathing loop volume (al)
x=fraction of oxygen in premixed gas supply
$x_C$=fraction of oxygen in gas in breathing loop

EXISTING SEMI-CLOSED CIRCUIT SETS

Figure 1:
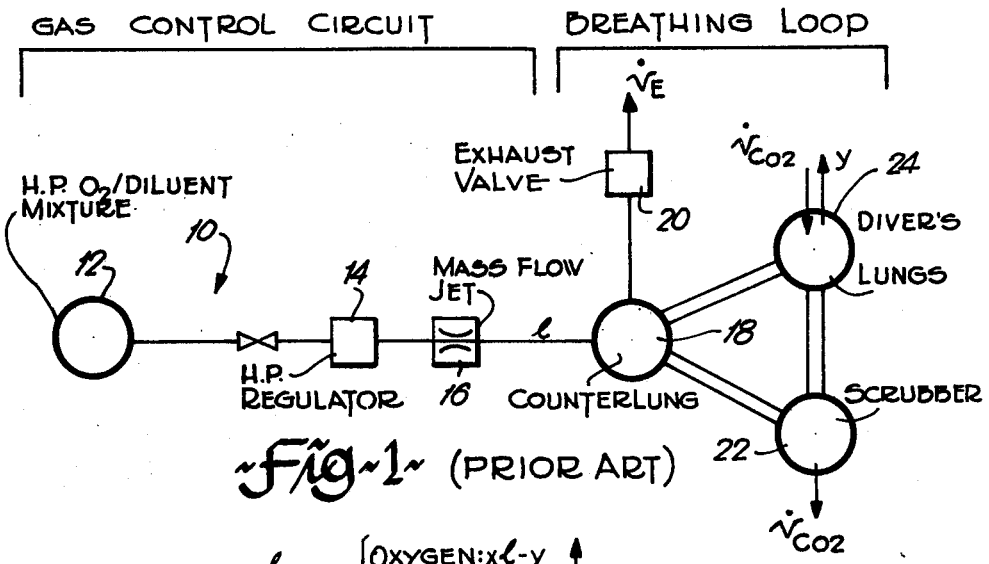
Fig. 1 (PRIOR ART)
FIG. 1 shows a conventional prior art semi-closed breathing apparatus.

FIG. 1 is a schematic of the gas control circuit and breathing loop 10 which is found in existing sets. An oxygen/inert gas mixture is fed from a source 12 through a high pressure regulator 14 and a mass flow jet 16 to the counterlung 18. Gas transfers are taking place at the supply gas inlet to the counterlung 18, the exhaust valve 20, the scrubber 22 and the diver's lungs 24.

In most derivations of the static counterlung $P_{02}$ equation, two assumptions are made. These are:

(i) The net carbon dioxide transfer in the breathing loop is negligible.

(ii) The breathing loop oxygen content is homogeneous and is the net result only of the gas transfers across the boundaries of the loop.

Figure 2:
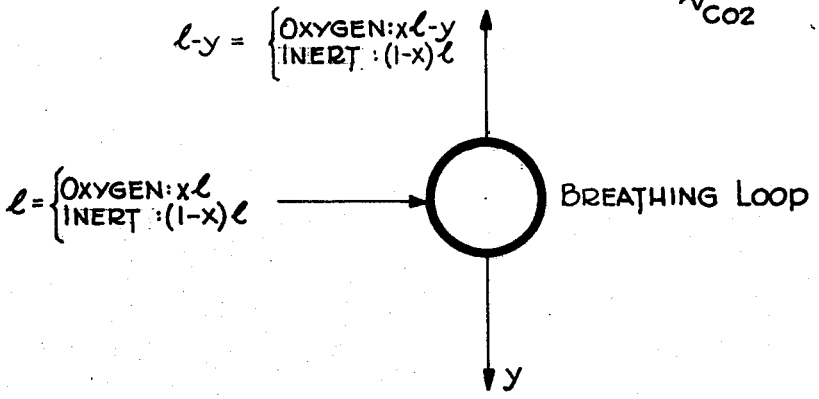
Fig. 2 (PRIOR ART)
FIG. 2 shows the balance of breathing loop gas flows in the apparatus of FIG. 1.

Using these assumptions and the breathing loop flow diagram of FIG. 2, a steady state $P_{02}$ equation can be derived. It is:

$$P_{02}=(xl-y)P/l-y \qquad 1)$$

Equation (1) is shown plotted in FIG. 3 for diver oxygen uptakes of 0.25 and 2.0 slm. The gas mixture and flow rate are those required to maintain a steady state $P_{02}$ between 0.2 and 2.0 ATA.

Several characteristics of this type of gas control can be seen in equation (1) and FIG. 3. Firstly, on a given gas control setting and for a constant oxygen uptake, the relationship is linear. This linearity stems from the fact that the supply gas composition and mass flow rate are constant. When values are applied to the constants it is seen that the slope is positive. This means that the $P_{02}$ is low near the surface and high at depth. It is the above characteristics that make a static analysis sufficient for this type of semiclosed circuit gas control.

IMPROVED SET OF BRITISH PAT. NO. 1,342,155

Two factors combine to produce the varying $P_{02}$ in the breathing loop of the apparatus described hereinabove. Firstly, the control system supplies a gas of constant composition to the breathing loop. This results in a supply gas of varying $P_{02}$. Secondly, the variable oxygen uptake of the diver further contributes to $P_{02}$ variations in the breathing loop.

The gas control method of British Pat. No. 1,342,155 eliminates the first factor contributing to breathing loop $P_{02}$ variation by supplying a constant $P_{02}$ gas mixture to the loop. Hence it can be called a constant partial pressure set. The variable diver oxygen uptake remains as a factor in producing variations in breathing loop $P_{02}$.

Figure 4:
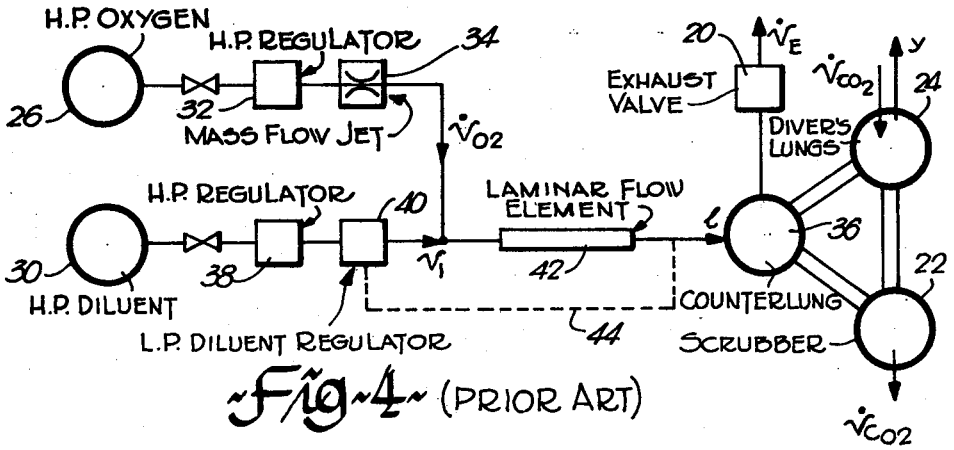
Fig. 4 (PRIOR ART)
FIG. 4, on the same sheet as FIG. 1, shows a prior art constant partial pressure breathing apparatus.

A schematic of this control circuit is shown in FIG. 4. The circuit illustrated in FIG. 4 utilizes a source 26 of oxygen and a separate source 30 of an inert gas such as helium or nitrogen. The oxygen passes through a high pressure regulator 32 and is metered by a mass flow jet 34 to give a constant mass flow supply to the counterlung 36. The inert gas is passed through a high pressure regulator 38 and a low pressure diluent regulator 40 and is then mixed with the oxygen and passed through a laminar flow element 42 to the counterlung 36. The reference pressure (i.e. the external pressure acting on the diaphragm of regulator 40) is arranged to be the same as the output pressure of the laminar flow element 42 by means of a feed-back loop 44 from the counterlung 36 to the regulator 40. By using the regulator 40 to produce a constant pressure drop, ΔP, across the laminar flow element 42 at all depths there is a constant actual volume flow of gas through the element 42 to the set.

The main components controlling the flow are the mass flow jet 34 and the laminar flow element 42. The mass flow jet 34 is a sonic venturi delivering a constant mass flow of oxygen as in existing sets. The laminar flow element 42 is a bank of small bore tubes across which the pressure drop is held constant by the low pressure regulator 40 and the feed-back loop 44. This results in the delivery of a constant actual volume flow rate "L" of mixture to the breathing loop.

The $P_{02}$ of the supply gas is:

$$P_{02}\,(\text{SUPPLY}) = \frac{(\dot{v}_{02})P}{l} = \frac{(\dot{v}_{02})P}{LP} = \frac{\dot{v}_{02}}{L} = \text{CONSTANT} \tag{2}$$

Using the two assumptions of the previous section, the steady state $P_{02}$ of the breathing loop can be written as:

$$P_{02} = \frac{(\dot{v}_{02} - y)P}{LP - y} \text{ FOR } \frac{\dot{v}_{02}}{P} < L \tag{3a}$$

$$P_{02} = P \text{ FOR } \frac{\dot{v}_{02}}{P} \geqq L \tag{3b}$$

The reason for the two-condition equation is that the laminar flow element 42 is designed to pass a certain actual flow rate, L, at a particular pressure drop, ΔP, controlled by the low pressure diluent regulator 40. If the actual flow of oxygen through the mass flow jet 34, $\dot{V}_{02}/P$, is greater than or equal to L, the pressure drop across the laminar flow element 42 will be greater than or equal to ΔP and the low pressure diluent regulator 40 will shut off. The control circuit will then deliver pure oxygen to the breathing loop and equation **3*b*** will hold.

Another important characteristic of this system is the rising mass flow of mixture with depth, which means more economical gas consumption than in conventional apparatus because of low near-surface standard volume flow. It is these characteristics which lead to the necessity of a dynamic analysis for the design of this type of apparatus.

THE DYNAMIC CASE

In considering a dynamic analysis of breathing loop $P_{02}$, reconsideration of the assumptions introduced in the analysis of existing semi-closed circuit sets is required. The first assumption is justified in that the carbon dioxide produced by the diver is almost completely removed from the breathing loop by the scrubber and exhaust valve. The second assumption is an approximation and is only true in the steady state. It fails to recognize the capacity of the breathing loop. The oxygen content at any time is not only the result of gas transfers across the breathing loop boundaries but also of the gas composition in the loop at the time of interest.

Two other factors become important in a dynamic analysis. One is the addition of extra gas to the breathing loop for pressure compensation during descent and the other is the venting of extra gas from the breathing loop for the same reason during ascent.

An approach which can be taken is to look at the breathing loop as a system of volume, $V_S$, and write a computer program which keeps track of the oxygen transfers going on and uses the results to evalute the breathing loop $P_{02}$ as a function of time.

Going back to first principals then the breathing loop $P_{02}$ is a function of the composition of oxygen in the loop and the depth in atmospheres absolute:

$$P_{02} = \chi_c P = \frac{(v_{02})P}{v_s} = \frac{(v_{02})P}{V_s P} = \frac{v_{02}}{V_s} \tag{4}$$

Equation (4) further indicates that breathing loop $P_{02}$ is equal to the ratio of the standard volume of oxygen in the loop to the actual volume of the loop.

Figure 6:
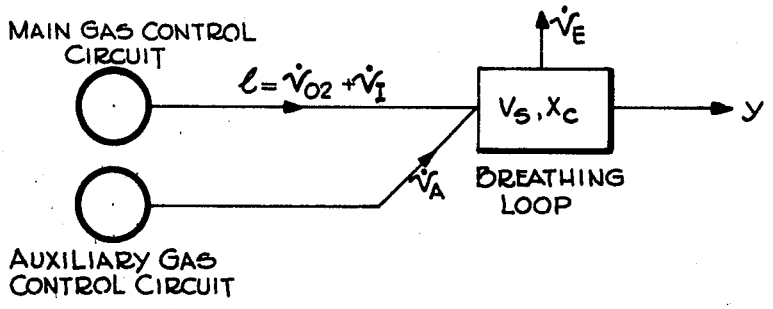
FIG. 6, shows the balance of breathing loop gas flows in any semi-closed circuit breathing apparatus.

It remains to evaluate the standard volume of oxygen in the breathing loop. FIG. 6 is a generalized diagram showing the flows in a semi-closed circuit breathing apparatus. All flows shown are referred to standard conditions.

The following terms can be defined:

$\int \dot{v}_{02}dt$ = the total oxygen delivered to the breathing loop by the main gas control circuit in time t. (sl).

$\int y dt$ = the total oxygen consumed by the diver in time t. (sl).

$\int X_c \dot{v}_E dt$ = the total oxygen vented by the exhaust value in time t. (sl).

$\int z \dot{v}_A dt$ = the total oxygen delivered to the breathing loop by the auxiliary gas control circuit in time t. (sl).

$v'_{02}$ = the volume of oxygen in the breathing loop at time t=0 (sl).

Therefore the Breathing Loop $P_{02}$ is:

$$P_{02} = 1/V_S[v'_{02} + (\int \dot{v}_{02}dt - \int y dt) - \int X_c \dot{v}_E dt + \int z \cdot \dot{v}_A dt] \tag{5}$$

The term in parenthesis is the net physiological oxygen delivered to the breathing loop by the main gas control circuit in time t (sl). i.e., It is based on the net oxygen flow required to maintain physiologically safe steady state oxygen levels.

The evaluation of the first three terms is straight-forward. The first term, $v'_{02}$, is a constant for each dive profile as is the parameter, $\dot{v}_{02}$. The oxygen uptake y is a constant for each leg of a dive profile. These parameters are easily entered into a program which calculates one leg of a dive profile at a time.

In the last two terms, the parameters $\dot{v}_E$ and $\dot{v}_A$ can be evaluated on the basis of the assumption that the acutal volume of the breathing loop does not change. This means that there will be a predictable balance between the parameters $\dot{V}_C$, $\dot{V}_{PH}$, $\dot{V}_A$ and $\dot{V}_E$ for all legs of a dive profile:

Where:

$\dot{V}_C$ = The compensation requirement i.e., the gas flow into or out of the breathing loop required to compensate for the effect of ambient pressure change (alm)

$$\dot{V}_c = V_S \dot{P}/P \tag{6}$$

$\dot{V}_{PH}$ = The net physiological gas flow to the breathing loop which maintains physiologically safe steady state $P_{02}$ levels. (alm). From FIG. (6):

$$\dot{V}_{PH} = \dot{V}_I + \dot{V}_{02} - Y \tag{7}$$

The balance referred to is defined by the following three conditional equations:

$$\text{If } \dot{V}_{PH} > \dot{V}_C \text{ then } \dot{V}_A = 0 \quad \text{and } \dot{V}_E = \dot{V}_{PH} - \dot{V}_C \tag{8a}$$

$$\text{If } \dot{V}_{PH} = \dot{V}_C \text{ then } \dot{V}_A = 0 \quad \text{and } \dot{V}_E = 0 \tag{8b}$$

$$\text{If } \dot{V}_{PH} < \dot{V}_C \text{ then } \dot{V}_A = \dot{V}_C - \dot{V}_{PH} \text{ and } \dot{V}_E = 0 \tag{8c}$$

Using the above, the parameters $\dot{V}_A$ and $\dot{V}_E$ can be evaluated for any leg of a dive profile. For instance, consider the diver working at a constant depth. Since $\dot{P}=0$, then $\dot{V}_C=0$ (equation 6). Since $\dot{V}_{PH}$ is always positive equation (8a) governs and therefore $\dot{V}_A=0$ and $\dot{V}_E=\dot{V}_{PH}$. $\dot{V}_{PH}$ is known since it is defined by main gas control circuit setting and diver oxygen uptake (equation 7).

In order to apply equation (5) to specific apparatus, each of its terms must be evaluated. This process ranges from selection of a value on the basis of initial conditions, diver oxygen uptake and gas control circuit setting, to evaluation based on Equation (8). The following table shows how the terms are evaluated for conventional sets and the new constant partial pressure set.

TABLE 1

| PARAMETER | CONVENTIONAL SET | CONSTANT PARTIAL PRESSURE SET |
|---|---|---|
| $v'_{02}$ | Select | Select |
| $\dot{v}_{02}$ | = xl | Select by adjustment of MFJ |
| y | Select | Select |
| $x_C$ | $= \frac{P_{02}}{P}$ | $= \frac{P_{02}}{P}$ |
| $\dot{v}_E$ and $\dot{v}_A$ | Evaluate from eqtn. (8) where: $\dot{V}_{PH} = \frac{l}{P} - \frac{y}{P}$ | Evaluate from eqtn. (8) where: $\dot{V}_{PH} = L - \frac{y}{P}$ |
| z | = x | Select by adjustment of bypass jets. |

Figure 7:
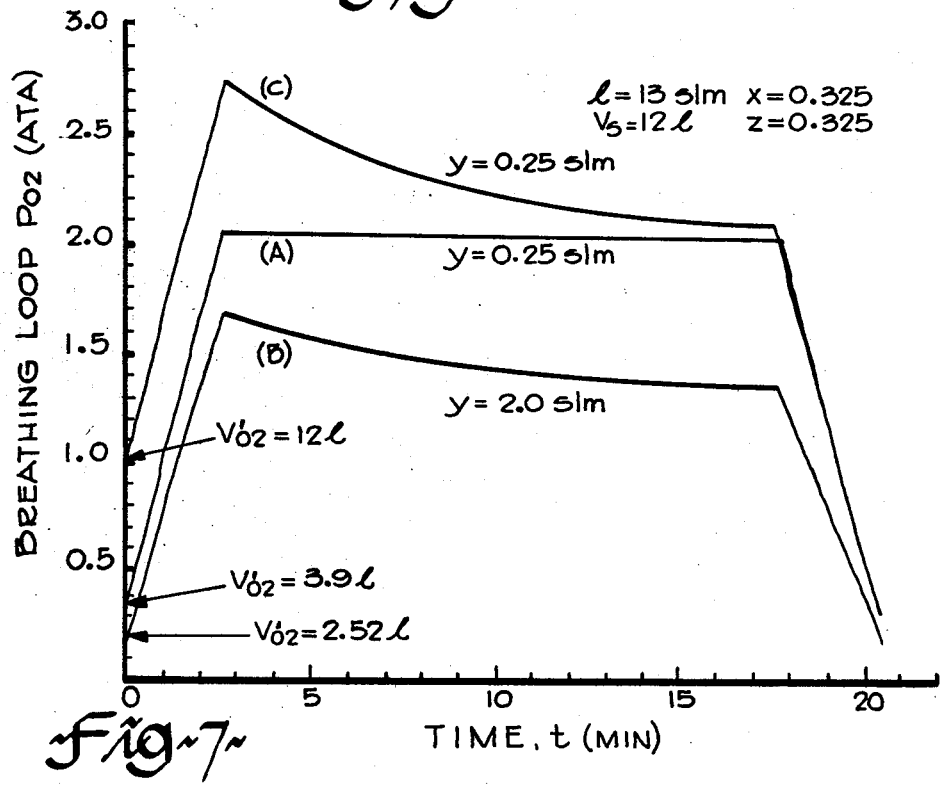
FIG. 7, shows a graph of oxygen partial pressure versus time for the apparatus of FIG. 1 on dives to 6.4 ATA.
Figure 8:
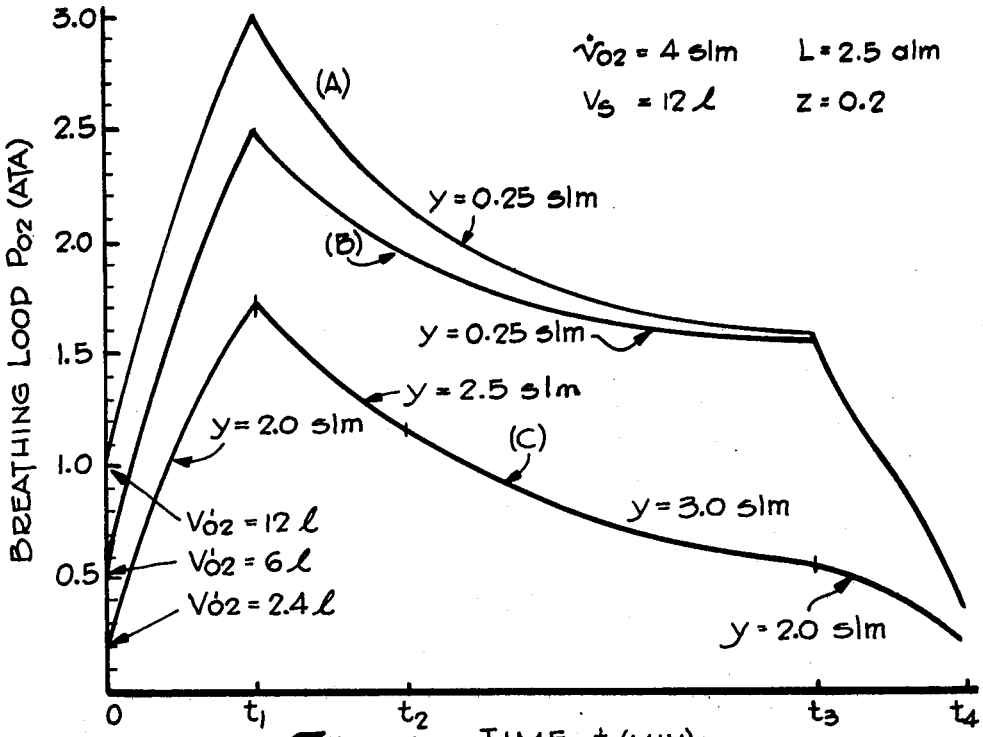
FIG. 8 shows a graph of oxygen partial pressure versus time for the apparatus of FIG. 4.

FIGS. 7 and 8 are plots of equation 5 for a conventional and constant partial pressure apparatus. The gas control circuit settings are the same as those used in the steady state $P_{02}$ performance curves of FIGS. 3 and 5 respectively and the breathing loop volume has been taken as 12 liters.

The curves represent a simple dive profile consisting of a descent to depth (0 to 2.7 min. in FIG. 7; 0 to $t_1$ in FIG. 8), an interval at constant depth (2.7 to 17.7 min. in FIG. 7; $t_1$ to $t_3$ in FIG. 8) and an ascent to the surface (17.7 to 20.4 min. in FIG. 7; $t_3$ to $t_4$ in FIG. 8). The profile purposely ignores decompression stops since it is intended to represent a "worst case" situation as far as transient $P_{02}$ is concerned, i.e., then $P_{02}$ drops more drastically on a direct ascent than it does on one broken up by stops.

Curve (A) of FIG. 7 shows the $P_{02}$ performance of the conventional set at low oxygen uptake. It assumes that the diver has purged the set and his lungs before starting the dive. This leaves the breathing loop full of gas of 32.5% oxygen. ($V'_{02}=0.325\times 12=3.9$ l). Curve (B) shows the $P_{02}$ performance at the maximum oxygen uptake intended for the flow and mixture settings shown. Here, the dive is started with the breathing loop filled with air ($V'_{02}=0.21\times 12=2.52$ l).

Curves (A) and (B) then, represent the upper and lower bounds of breathing loop $P_{02}$ for the conventional set on this dive profile. Note that the $P_{02}$ is well controlled with no dangerous $P_{02}$ excursions. If this apparatus were to start the dive with pure oxygen in the breathing loop, the $P_{02}$ would tend to overshoot (Curve C). This is because of the relatively low flow rate and high oxygen content of the supply gas. This is typical of the supply gas of conventional sets when rigged for shallow dives such as the one shown. For deeper dives though, the flow rate setting becomes higher and the oxygen content of the mixture lower, lessening the $P_{02}$ overshoot tendancy. However, the real saving grace for conventional semi-closed circuit sets is that it is impossible for them to develop pure oxygen in their breathing loops. They must start a dive with a breathing loop oxygen content somewhere between that of air and the supply gas in their storage bottles; i.e., between 21% and 60%. This, coupled with the relatively high and constant mixture flow rates required for the deeper dives, keeps the transient $P_{02}$ within limits on descent. On ascent, the relatively high "at-depth" $P_{02}$ (See FIG. 3) and mixture flow rate keep the $P_{02}$ from dropping below 0.2 ATA.

It can be seen from the above that a static analysis of breathing loop oxygen partial pressure has been sufficient in the design and operation of conventional semi-closed circuit apparatus in the past because, due to the nature of the gas control method, the problem tends to take care of itself. This fact coupled with the design tool of instrumented test dives and operational practices such as purging before ascent have resulted in the successful building and use of such apparatus.

The transient $P_{02}$ factor becomes more important when it comes to the design of a constant partial pressure set as can be seen in FIG. 8. As discussed with respect to the static case the gas control circuit delivers pure oxygen down to 1.6 ATA depth and oxygen rich mixture in the next few atmospheres thereafter. (Eqtn.2). Therefore it is possible for the constant partial pressure set to start a dive on pure oxygen with the result as shown by curve (A) in FIG. 8. Even with purging before descent, the $P_{02}$ transient can be quite aggravated. (Curve B of FIG. 8). Note that Curve (B) assumes an incomplete purge using a 20% oxygen bypass mixture. This is more realistic than expecting a given purge exercise to bring the $P_{02}$ down to 0.2 ATA.

Curve (C) in FIG. 8 shows a dive on a high oxygen uptake schedule. This schedule is intended to represent the maximum oxygen uptake the diver can maintain. It also assumes the diver has been able to completely purge his set before diving. So curve (C) defines the lower bound of oxygen partial pressure for the dive profile. Note that the $P_{02}$ on ascent drops to slightly below 0.2 ATA. This is due to the relatively low at-depth $P_{02}$ and the decreasing mass flow rate of mixture on ascent. Although the drop in $P_{02}$ on ascent is a borderline case, it requires some form of compensation to ensure a margin of safety.

The significant transient $P_{02}$ excursions revealed in FIG. 8 are not indicated in the steady-state curve of FIG. 5. Therefore a static analysis is insufficient and a dynamic analysis becomes necessary in the design of constant partial pressure apparatus.

The problem of transient $P_{02}$ can be summarized as follows: For a constant partial pressure gas control circuit adjusted to maintain bounded steady state oxygen partial pressure in a breathing loop with minimum oxygen and diluent flows:

(i) Low, oxygen-rich mixture flow rate near the surface causes excessive transient oxygen partial pressure excursion on descent, and (ii) A low oxygen partial pressure for high diver oxygen uptake at depth causes low transient oxygen partial pressure on ascent.

A system is required which eliminates the problem. This system should meet the following objectives:

(i) Maintain the steady state $P_{02}$ within limits over the entire depth range for all diver oxygen uptakes.

(ii) Maintain the transient $P_{02}$ within limits for all maneuvers over the entire depth range for all oxygen uptakes.

(iii) Accomplish (i) and (ii) with minimum gas consumption.

(iv) Accomplish (i), (ii) and (iii) with minimum system complexity.

Several paths are open to accomplish the objectives. These range from using a high flow rate main control circuit setting which doesn't need any auxiliary compensation circuitry; to systems using the minimum flows discussed earlier but requiring complex auxiliary systems. The trade-off is one of gas economy versus system complexity.

It turns out that a solution to the problem exists which maintains good gas economy and is very simple. It consists of the addition of an oxygen accumulator to the oxygen supply line downstream of the mass flow jet. (See FIG. 9).

Figure 9:
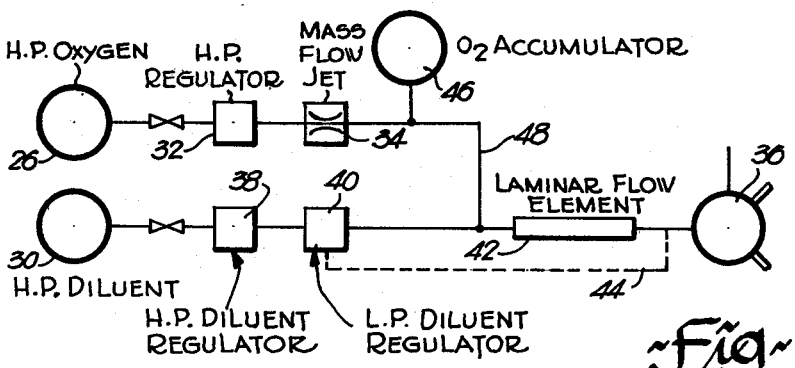
FIG. 9 on the same sheet as FIG. 6, shows the apparatus of the present invention.

FIG. 9 shows a system similar to that of British Pat. No. 1,342,155 with an oxygen accumulator included therein. The system includes all of the elements identified as in FIG. 4 and furthermore adds the oxygen accumulator 46 connected to the conduit 48 leading from the mass flow jet 34 to the laminar flow element 42.

As the diver descends, some of the oxygen delivered by the mass flow jet 34 is diverted into the accumulator 46 thus reducing the oxygen delivered to the breathing loop. This tends to counteract $P_{02}$ overshoot on descent. At constant depth, the accumulator 46 retains the oxygen it collected on the descent and the normal oxygen flow rate to the breathing loop is restored. On ascent, the accumulator 46 discharges its contents and excess oxygen is delivered to the breathing loop. This counteracts dropping $P_{02}$ on ascent.

Figure 10:
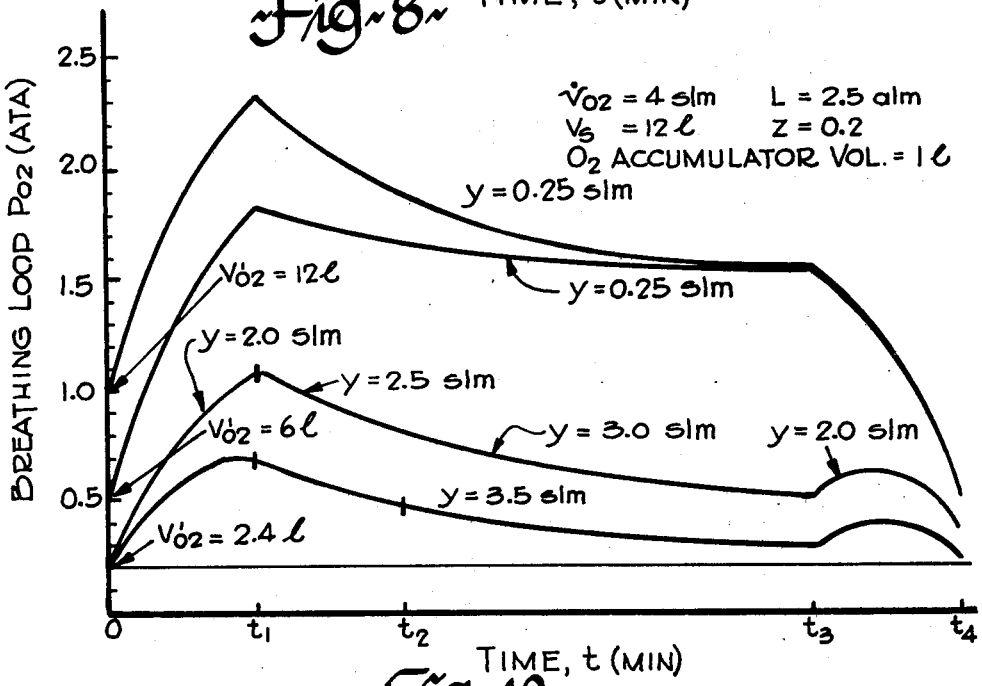
FIG. 10 shows a graph of oxygen partial pressure versus time for the apparatus of FIG. 9.

FIG. 10 shows the dynamic $P_{02}$ performance of an apparatus using such a circuit. Note that the $P_{02}$ is still aggravated on descent when a dive is started on pure oxygen. Hence, purging before descent is required to bring the breathing loop $P_{02}$ down to around 0.5 ATA. If this is done the $P_{02}$ remains well controlled.

FIG. 9 shows the oxygen accumulator in parallel with the flow conduit 48 but it could also be provided in series, i.e., directly in the line 48. In this configuration there would be provision for automatic flushing of the accumulator, to ensure that it always contains pure $O_2$. This configuration would be useful for providing flushing prior to initial use after storage or maintenance when air or other gases may have entered the accumulator.

In summary therefore, the use of a dynamic analysis in the design of a new constant partial pressure semi-closed circuit breathing apparatus has led to the successful design of its gas control circuit. The use of a dynamic analysis was necessary in this type of apparatus because of the varible nature of the gas control circuit. It also makes it a simple matter to evaluate the effects of auxiliary circuit gas flows, purging procedures and different dive rates. While other embodiments of the present invention may occur to skilled persons in the art, the protection to be afforded the present invention should be determined from the claims appended hereto.

The embodiment of the invention in which an exclusive property or privilege is claimed are defined as follows:

1. Semi-closed circuit breathing apparatus comprising: a counterlung; an oxygen source; means for feeding oxygen from the oxygen source to an oxygen regulator and then to a mass flow jet; an inert gas source; means for feeding inert gas from the inert gas source to an inert gas regulator and then to an inert gas low pressure diluent regulator; a laminar flow element; first conduit means connected between said diluent regulator and said laminar flow element; second conduit means connected between said mass flow jet and said first conduit means; third conduit means connected between said laminar flow element and said counterlung; a pressure feed-back loop from said counterlung to said diluent regulator; oxygen accumulator means for accumulating a portion of the oxygen delivered by said mass flow jet during descent, to be retained therein at a constant depth, and for discharging the retained oxygen into said second conduit means during ascent so as to counteract oxygen partial pressure transients during descent and ascent; and means directly connecting said accumulator means to said second conduit means.

2. The apparatus of claim 1 wherein said oxygen accumulator is in parallel with said second conduit means and is in flow communication therewith by way of said connecting means.

3. The apparatus of claim 1 wherein said oxygen accumulator is in series with said second conduit means.

4. In the method of supplying a variable gas mixture of constant oxygen partial pressure to a diver's semi-closed breathing apparatus wherein oxygen is supplied via a constant mass flow device, is mixed with an inert gas, and the mixture is supplied via a laminar flow element to a counterlung of the breathing apparatus with the supply thereof being regulated by a feed-back loop to ensure a constant pressure drop across the laminar flow element, the improvement wherein a portion of the supplied oxygen is accumulated in an oxygen accumulator during descent to counteract oxygen partial pressure overshoot, is retained in the accumulator at constant depth, and is returned to the breathing apparatus during ascent to counteract dropping oxygen partial pressure.

* * * * *